US007215125B2

(12) United States Patent
Clark

(10) Patent No.: US 7,215,125 B2
(45) Date of Patent: May 8, 2007

(54) METHOD FOR MEASURING A FORMATION PARAMETER WHILE INSERTING A CASING INTO A WELLBORE

(75) Inventor: Brian Clark, Sugar land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 56 days.

(21) Appl. No.: 10/907,515

(22) Filed: Apr. 4, 2005

(65) Prior Publication Data

US 2006/0220651 A1 Oct. 5, 2006

(51) Int. Cl.
*G01V 3/18* (2006.01)

(52) U.S. Cl. ..... 324/368

(58) Field of Classification Search ..... 324/366–375
See application file for complete search history.

(56) References Cited

U.S. PATENT DOCUMENTS

| | | | | |
|---|---|---|---|---|
| 4,041,780 | A | 8/1977 | Angehrn | |
| 4,047,430 | A | 9/1977 | Angehrn | |
| 4,349,072 | A | 9/1982 | Escaron et al. | |
| 4,457,370 | A * | 7/1984 | Wittrisch | 166/254.2 |
| 5,305,830 | A * | 4/1994 | Wittrisch | 166/250.01 |
| 5,433,276 | A | 7/1995 | Martain et al. | |
| 5,543,715 | A | 8/1996 | Singer et al. | |
| 5,596,142 | A | 1/1997 | Delpuech et al. | |
| 5,809,458 | A | 9/1998 | Tamarchenko | |
| 6,119,777 | A | 9/2000 | Runia | |
| 6,308,561 | B1 | 10/2001 | Samworth et al. | |
| 6,693,554 | B2 | 2/2004 | Beique et al. | |
| 6,702,041 | B2 * | 3/2004 | Runia | 175/40 |
| 6,705,413 | B1 | 3/2004 | Tessari | |
| 6,747,570 | B2 | 6/2004 | Beique et al. | |
| 7,044,241 | B2 | 5/2006 | Angman | |
| 2002/0149499 | A1 | 10/2002 | Beique et al. | |

OTHER PUBLICATIONS

Runia, J. et al., "Through Bore Drilling Systems: a New Drilling Option," SPE/IADC 79794, SPC/IADC Drilling Conference, Amsterdam, NL (Feb. 19-21, 2003).

* cited by examiner

*Primary Examiner*—Jay M. Patidar
(74) *Attorney, Agent, or Firm*—Kevin P. McEnaney; Dale V. Gandier

(57) ABSTRACT

A system for determining a subsurface parameter from a drilled wellbore includes a casing, a logging tool comprising one or more logging devices, and a latching device coupling the logging tool to the casing such that the logging tool hangs below the casing when the casing is disposed in the wellbore. A method of determining a subsurface parameter includes disposing a casing in a wellbore, coupling the logging tool to the casing such that the logging tool hangs below the casing, and running the casing along the wellbore, wherein the logging tool makes measurements as the casing is run along the wellbore.

18 Claims, 3 Drawing Sheets

METHOD FOR MEASURING A FORMATION PARAMETER WHILE INSERTING A CASING INTO A WELLBORE

FIELD OF THE INVENTION

The invention relates generally to methods and apparatus for obtaining formation evaluation logs from a wellbore drilled with a drillstring. More specifically, the invention relates to a method and an apparatus for obtaining a formation evaluation log from an open hole of a wellbore drilled with a drillstring.

BACKGROUND OF THE INVENTION

Formation evaluation logs contain data related to one or more properties of a formation as a function of depth. Many types of formation evaluation logs, e.g., resistivity, acoustic, and nuclear, are recorded by appropriate downhole instruments placed in a housing called a sonde. A logging tool including a sonde and associated electronics to operate the instruments in the sonde is lowered into a wellbore penetrating the formation to measure properties of the formation. To reduce logging time, it is common to include a combination of logging devices in a single logging run. Formation evaluation logs can be recorded while drilling or after drilling a section of the wellbore. Formation evaluation logs can be obtained from an open hole (i.e., an uncased portion of the wellbore) or from a cased hole (i.e., a portion of the wellbore that has had metal casing placed and cemented to protect the open hole from fluids, pressure, wellbore stability problems, or a combination thereof). Formation evaluation logs obtained from cased holes are generally less accurate than formation evaluation logs obtained from open holes but they may be sufficient in some applications, such as in fields where the reservoir is well known.

Wellbores are conventionally drilled using a drillstring. The drillstring generally includes a series of drillpipe and a bottomhole assembly (BHA). The BHA includes at least a drill bit and may further include components that would turn the drill bit at the bottom of the wellbore. Oftentimes, the BHA includes a bit sub, a mud motor, and drill collars. The BHA may also include measurement-while-drilling (MWD)/logging-while-drilling (LWD) tools and other specialized equipment that would enable directional drilling. In conventional drilling, casings are typically installed in the wellbore to prevent the wellbore from caving in or to prevent fluid and pressure from invading the wellbore. The first casing installed is known as the surface casing. This surface casing is followed by one or more intermediate casings and finally by production casing. The diameter of each successive casing installed into the wellbore is smaller than the diameter of the previous casing installed into the wellbore. The drillstring is lowered into the wellbore to drill a new section of the wellbore and then tripped out of the wellbore to allow the casing to be installed in the wellbore. As discussed in further detail below, logging may be conducted in the wellbore while the new section is being drilled or after the new section is drilled or while casing is run to the new section.

Traditionally, open hole formation evaluation logs have been obtained using wireline logging. In wireline logging, the formation properties are measured after a section of a wellbore is drilled but before a casing is run to that section of the wellbore. The operation involves lowering a logging tool to total depth of the wellbore using a wireline (armored electrical cable) wound on a winch drum and then pulling the logging tool out of the wellbore. The logging tool measures formation properties as it is pulled out of the wellbore. As a fallback in hostile environments, the logging tool may also measure formation properties as it is lowered into the wellbore. The wireline transmits the acquired data to the surface. The length of the wireline in the wellbore provides a direct measure of the depth of the logging tool in the wellbore. Wireline logging can provide high quality, high density data quickly and efficiently, but there are situations where wireline logging may be difficult or impossible to run. For example, in highly deviated or horizontal wellbores, gravity is frequently insufficient to allow lowering of the logging tool to total depth by simply unwinding the wireline from the winch drum. In this case, it is necessary to push the logging tool along the well using, for example, a drillpipe, coiled tubing, or the like. This process is difficult, time consuming, and expensive. Another situation where wireline logging may be difficult and risky is in a wellbore with stability problems. In this case, it is usually desirable to immediately run casing to protect the open hole.

LWD is a newer technique than wireline logging. It is used to measure formation properties during drilling of a section of a wellbore, or shortly thereafter. An LWD tool includes logging devices installed in drill collars. The drill collars are integrated into the BHA of the drillstring. During drilling using the drillstring, the logging devices make the formation measurements. The LWD tool records the acquired data in its memory. The recorded data is retrieved when drilling stops and the drillstring is tripped to the surface. During drilling, a subset of the acquired data may be sent to the surface using conventional telemetry systems. LWD data transmitted to the surface in real time may assist in making quick and accurate decisions with respect to directional drilling and hazards prevention. The range of LWD services available and logging speed are limited in comparison to wireline logging. In LWD, logging speed can be limited by the real time data-rate of the MWD tool's telemetry. In this case, the drilling rate may be slowed so that sufficient data can be sent uphole for drilling or formation evaluation decisions. However, LWD has an advantage over wireline logging in that properties of the formation are measured before drilling mud invades the formation deeply. Further, LWD can be used in wellbores that may prove difficult or even impossible to measure with conventional wireline logging. For example, because the LWD tool is part of the drillstring, it can easily log highly deviated and horizontal wellbores, whereas wireline logging may require pushing of the logging tools using drillpipe, coiled tubing, or the like.

Through-bore-logging (TBL) is a much newer technique than LWD. It allows open hole formation evaluation logs to be obtained without tripping the drillstring out of the wellbore. (See, for example, John Runia et al., "Through Bore Drilling Systems: a New Drilling Option," SPE 79794, February 2003). A typical TBL system includes a drilling string having a drill bit with a removable and re-insertable bit insert and a latch attached to the bit insert. During drilling, the latch is locked into the bit shank. The TBL system further includes a string of logging tools (e.g., gamma, resistivity, density, neutron, and sonic logging tools) and may include a MWD tool to allow real-time data transmission. When the drill bit reaches total depth, the drill string is pulled back and the string of logging tools is run on a slickline or pumped down the bore of the drill string. A special running tool attached to the bottom of the logging tools releases the latch from the bit shank, allowing the bit insert to be released from the drill bit, allowing the logging tools to pass through the drill bit. With the logging tools below the drill bit, logging occurs as the drill string is pulled back from the wellbore. After logging the open hole, the logging tools are pulled through the drill bit with a slickline. The latch locks itself to the bit shank and releases the special running tool at the bottom of the logging tools, allowing the logging tools to be removed from the drill string and drilling to continue.

U.S. Pat. No. 6,119,777 (Runia) describes a method of logging a conventionally drilled wellbore while running a casing into the wellbore. The lower end part of the casing run into the wellbore, referred to as the casing shoe track, is provided with a logging tool. The logging tool is releasably retained in a glass fiber reinforced epoxy (FRE) tube attached to the inner surface of the casing shoe track. In one example, the logging tool is composed of a gamma ray logging device, a neutron logging device, a density logging device, and a power/memory cartridge. Density measurements are made through a window in the casing shoe track formed of FRE. Some sections of the casing shoe track are made of glass FRE to optimize log response of tools affected by steel. In general, the casing shoe track is made of drillable materials so that it can be drilled out if necessary. The casing shoe track also allows through pumping of mud. Logging is conducted as the casing is run into the wellbore. After the casing is installed and prior to cementing the casing in place, a latching device is connected to the logging tool. The latching device is also connected to a wireline or coiled tubing provided with electrical conducting means, thereby allowing acquired data to be transferred from the logging tool to the surface. After transferring the data, the logging tool is retrieved, and the casing is then cemented in place.

A need remains for techniques to obtain open hole formation evaluation logs, particularly where LWD would not be cost-effective and wireline logging could be difficult and/or risky.

SUMMARY OF THE INVENTION

In one aspect, the invention relates to a system for determining a subsurface parameter. The system comprises a casing adapted for subsurface disposal, a logging tool comprising one or more logging devices, and a latching device coupling the logging tool to the casing such that the logging tool hangs below the casing when the casing is disposed in the wellbore.

In one embodiment, the latching device releasably couples the logging tool to the casing. In another embodiment, the latching device comprises a retrievable head that allows it to be retrieved through the casing. In one embodiment, the casing is equipped with a lock having a profile that engages a locking surface on the latching device. In another embodiment, the logging tool is sized to pass through the casing.

In one embodiment, one of the logging devices comprises a pad through which it senses a formation. In one embodiment, the logging tool further comprises a mechanism for biasing the pad against the formation. In another embodiment, the logging tool further comprises a hinge joint which allows pivoting of a section of the logging tool as the logging tool traverses the wellbore.

In another aspect, the invention relates to a method of determining a subsurface parameter. The method comprises disposing a casing in a wellbore, coupling a logging tool comprising one or more logging devices to the casing such that the logging tool hangs below the casing, and running the casing along the wellbore, wherein the logging tool makes measurements as the casing is run along the wellbore.

Other features and advantages of the invention will be apparent from the following description and the appended claims.

DETAILED DESCRIPTION OF THE INVENTION

The invention will now be described in detail with reference to a few preferred embodiments, as illustrated in accompanying drawings. In the following description, numerous specific details are set forth in order to provide a thorough understanding of the invention. However, it will be apparent to one skilled in the art that the invention may be practiced without some or all of these specific details. In other instances, well-known features and/or process steps have not been described in detail in order to not unnecessarily obscure the invention. The features and advantages of the invention may be better understood with reference to the drawings and discussions that follow.

Embodiments of the invention provide a method and system for obtaining open hole formation evaluation logs. The system includes a logging tool, a casing (or liner), and a latching device. The latching device is attached to the logging tool and is used to lock the logging tool to the casing such that the logging tool hangs below the casing. The logging tool is sized so that it is retrievable through the bore of the casing. The method includes running the casing into a wellbore. The logging tool may be latched to the casing before the casing is run into the wellbore or when the casing reaches the beginning of the open hole. With the logging tool hanging below the casing, the casing is run to the desired depth while the logging tool logs the open hole. The logging tool is retrieved through the bore of the casing.

Figure 1A:
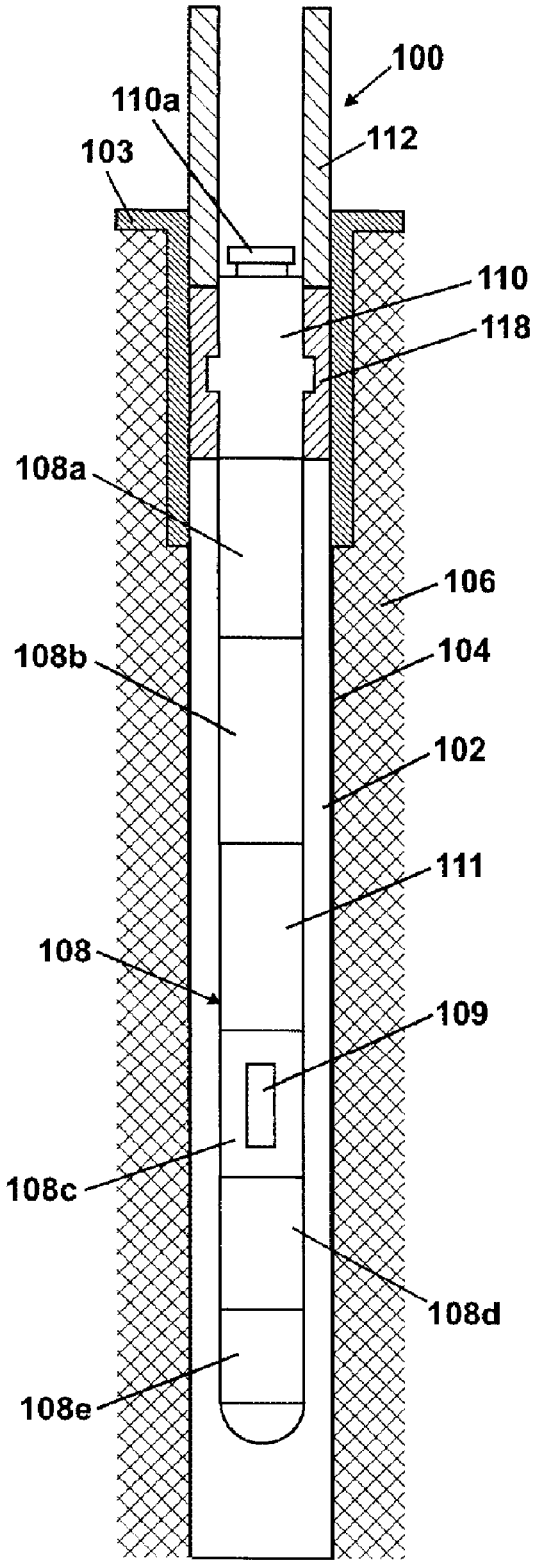
FIG. 1A illustrates a logging system according to an embodiment of the invention.
Figure 1B:
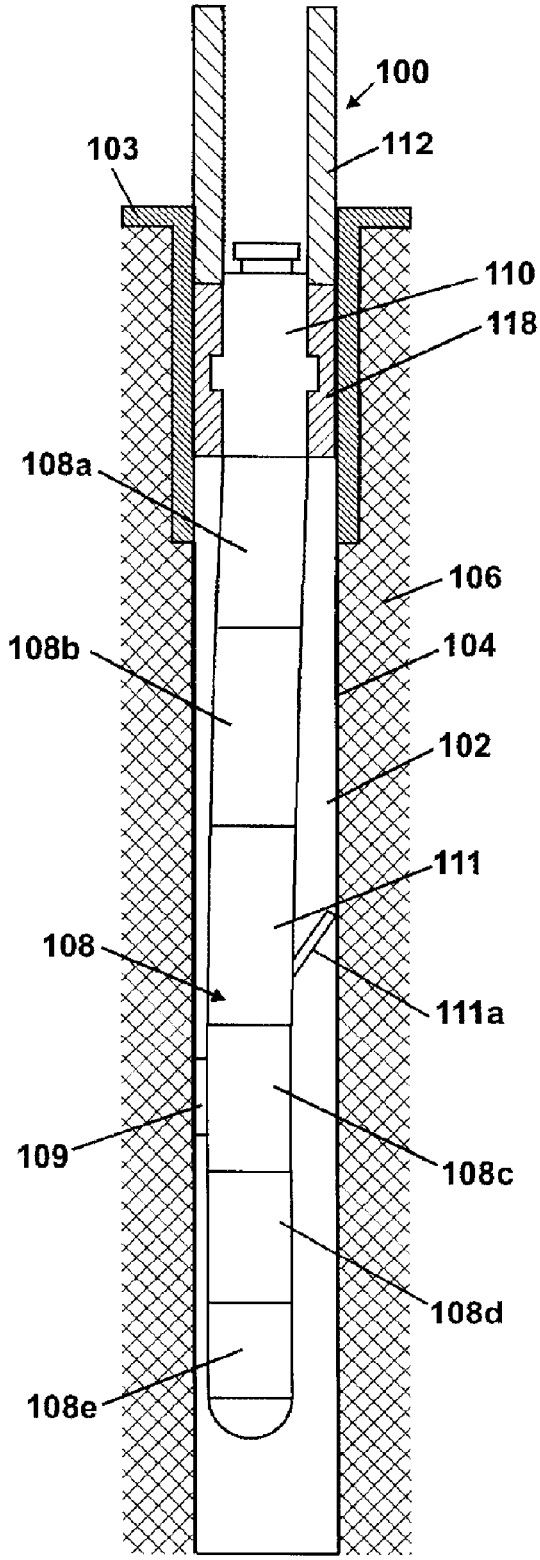
FIG. 1B shows a pad on a logging tool urged against a formation according to an embodiment of the invention.

FIG. 1A shows a logging system 100 being run into an open hole 102, i.e., an uncased portion of a wellbore 104 traversing a formation 106, according to one embodiment of the invention. In this example, a casing 103 has already been installed in a portion of the wellbore 104, and the open hole 102 is below the casing 103. It should be obvious that the drawing is not to scale. The logging system 100 is intentionally shown larger relative to the wellbore 104 and installed casing 103 to clearly illustrate the principles of the invention. The wellbore 104 is drilled in a conventional manner, i.e., using a drillstring (not shown). For a low-cost wellbore, it is preferable not to use LWD while drilling the open hole 102; although, mud logging or MWD gamma-ray logging may be made while drilling. The logging system 100 may be run into the open hole 102 immediately after tripping the drillstring out of the wellbore 104. The wellbore 104 may be vertical, as shown, or may be directional.

The logging system 100 includes a logging tool 108. The logging tool 108 includes logging devices 108*b*, 108*c*, 108*d*, and 108*e*. It should be noted that the logging tool 108 may include any number and combination of logging devices. Each logging device includes appropriate sensors and electronics for making measurements and recording measurements. For example, the logging tool 108 may include logging devices selected from the group consisting of acoustic tool, seismic sources/sensors, propagation/induction electromagnetic tool, neutron tool, density tool, neutron-density tool, gamma-ray, nuclear magnetic resonance (NMR) tool, formation pressure tool, imaging tool, dipmeter, ultrasonic caliper tool, gravity sensors, and combinations thereof. These tools are known in the art. However, certain modifications can be made to the tools to take full advantage of the invention. Some of these modifications will be discussed later. The logging tool 108 may further include a MWD telemetry tool 108*a*, which provides real-time data transmission over selected logging intervals.

The logging system 100 further includes a latching device 110 coupled to an upper end of the logging tool 108. The logging system 100 further includes a casing 112 equipped with an axial/torque lock 118. The axial/torque lock 118 includes a profile that engages a locking surface on the latching device 110, thereby locking the logging tool 108 to the casing 112. Preferably, the latching device 110 is releasable from the axial/torque lock 118. An example of a suitable axial/torque lock is available from Tesco Corporation under the trade name CASING PROFILE NIPPLE (CPN). An example of a suitable latching device is also available from Tesco Corporation under the trade name DRILL LOCK ASSEMBLY (DLA). When the latching device 110 engages the axial/torque lock 118, the logging tool 108 hangs below the casing 112. In this locked position, the latching device 110 receives torque and weight from the casing 112. The latching device 110 preferably includes a retrievable head (or fishing head) 110*a*, which would allow it to be retrieved through the bore of the casing 112.

In one specific example, the logging tool 108 includes a sonic or acoustic tool 108*b*, a density tool 108*c*, a gamma-ray tool 108*d*, and an electromagnetic (e.g. propagation) resistivity tool 108*e*. The density tool 108*c* includes a pad 109 through which it senses the formation 106. The pad 109 may be movable between a retracted position and a deployed position, or it may be fixed in position. The logging tool 108*c* may not be able to accurately determine the density of the formation 106 through the pad 109 if the standoff, i.e., the gap between the pad 109 and the formation 106, is larger than approximately 0.5 in (1.27 cm) during density measurements. Hence, a method for maintaining a small distance between the pad 109 and the formation 106 is desirable. Referring to FIG. 1A, if the pad 109 is fixed to the density tool 108*c*, and if the wellbore 104 is not strictly vertical, then the logging tool 108*c* may be oriented such that pad 109 is facing down. Gravity will then force the pad 109 against a side of the wellbore 104. Alternatively, the casing 112 may be slowly rotated as it is lowered into a non-vertical wellbore, and the density may be measured during the time when the pad 109 is oriented downward. Magnetometers and accelerometers in the logging tool 108 can be used to determine the orientation of the pad 109.

In one embodiment, the logging tool 108 is equipped with a mechanism for biasing the pad 109 against the wellbore 104. As illustrated in FIG. 2C, the mechanism includes a sub 111 near the density tool 108*c*. The sub 111 has an extendable arm 111*a* that is diametrically opposed to the pad 109. Typically, the extendable arm 111*a* is held retracted until the logging tool 108 reaches the open hole 102. When the logging tool 108 reaches the open hole 102, the extendable arm 111*a* is released and urged against a side of the wellbore 104. This forces the pad 109 against the formation 106. Any suitable mechanism, e.g., spring, may be used to urge the extendable arm 111*a* against the wellbore 104. In the extended position, the extendable arm 111*a* may also provide caliper measurements as the logging tool 108 traverses the open hole 102. When the extendable arm 111*a* is deployed, the portion of the logging tool 108 between the density tool 108*c* and the casing 112 may be allowed to deflect as shown in the drawing. Alternatively, a hinge joint, such as provided by spacer sub 107 (FIG. 2C) and pivot connections 107*a*, 107*b* (FIG. 2C), may be suitably located in the logging tool 108 so that the pad 109 is biased against the formation 106 without deflecting the portion of the logging tool 108 between the density tool 108*c* and the casing 112.

Returning to FIG. 1A, the open hole 102 of the wellbore 104 has been drilled to a desired depth using a drillstring (not shown). The open hole 102 may have been drilled vertically or directionally. The drillstring may have included a BHA (not shown) having a steerable motor and a MWD tool. The MWD tool (not shown) may have been used for low-level formation evaluation, e.g., mud logging or gamma-ray logging, while drilling. To minimize costs, the BHA preferably did not include LWD tools. The drillstring has been tripped out of the wellbore 104. In one example, it is already known that the wellbore 104 is not stable enough to be left open for long periods needed for wireline logging or that it is more cost-effective to run in casing immediately to save rig time. Using the logging system 100 of the present invention, logging can be conducted while running casing 112 into the open hole 102.

Figure 2A:
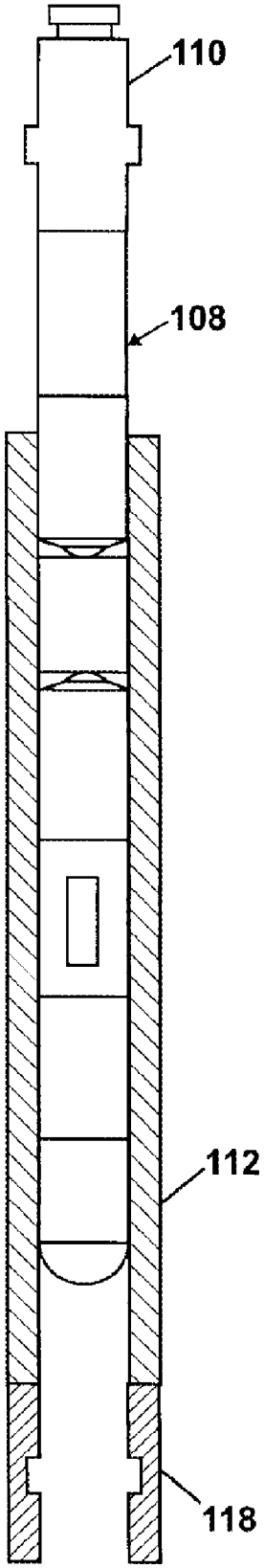
FIGS. 2A–2D illustrate a procedure for logging while casing according to an embodiment of the invention.
Figure 2B:
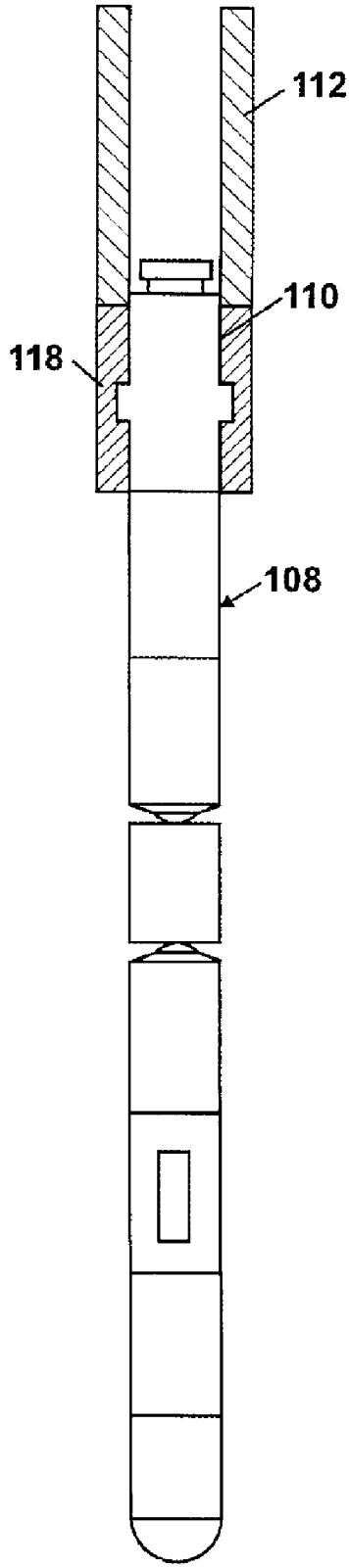
Figure 2C:
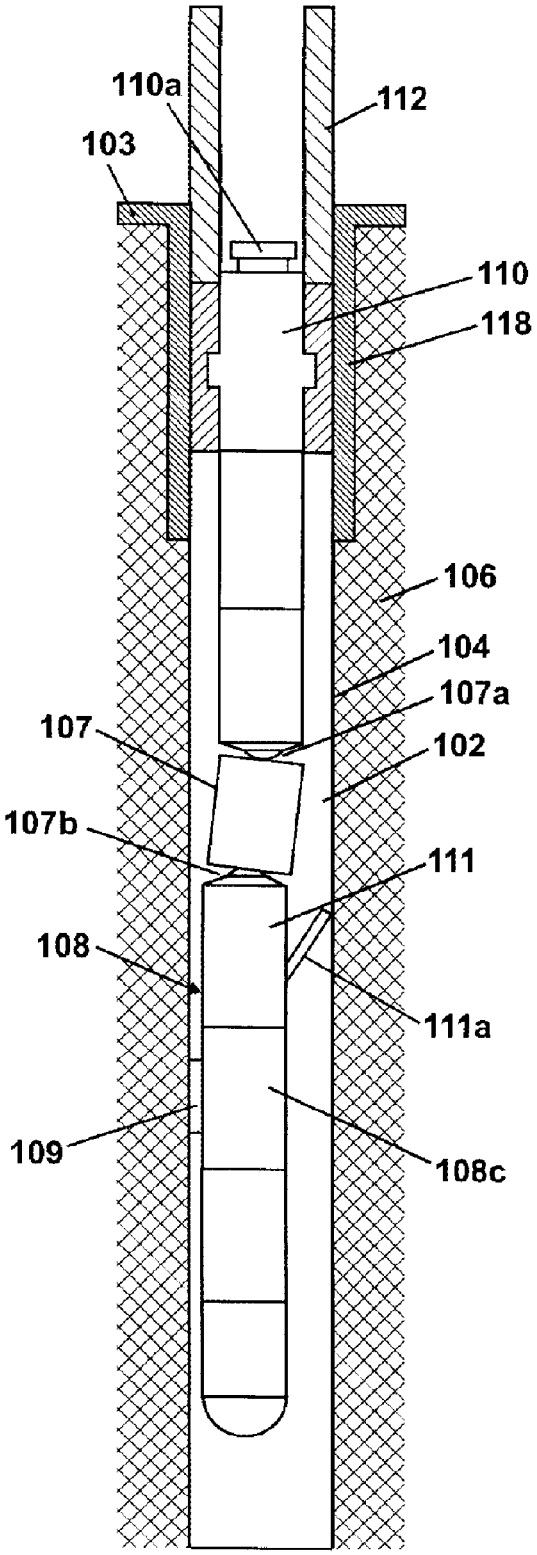
Figure 2D:
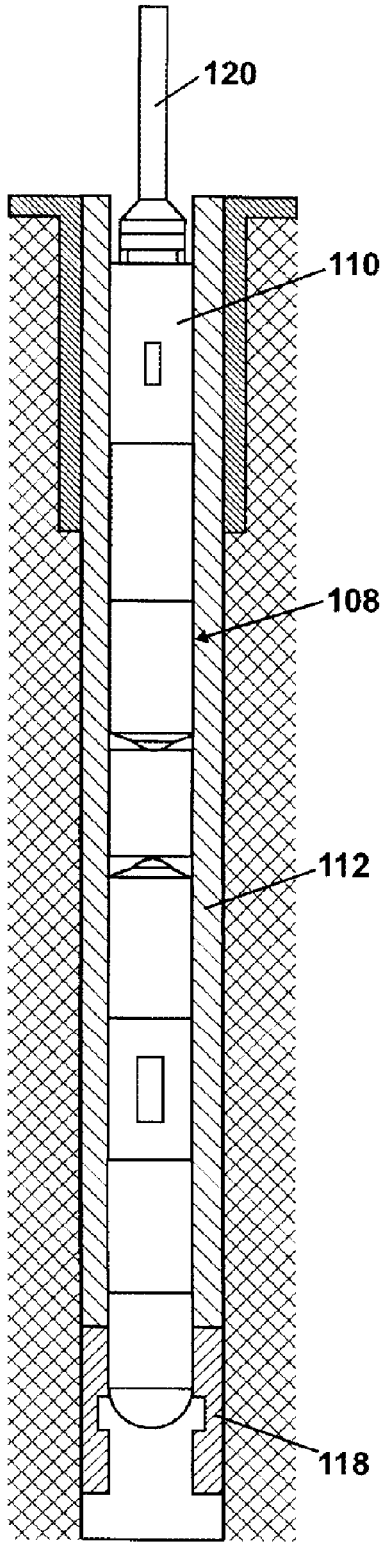

FIGS. 2A–2D illustrate a procedure for logging while casing the open hole 102. At the surface, the latching device 110 is attached to the top of the logging tool 108 (FIG. 2A). The axial/torque lock 118 is also attached to the bottom end of the casing 112 (FIG. 2A). Then, the latching device 110 and logging tool 108 are run into the casing 112 until the latching device 110 engages the axial/torque lock 118, leaving the logging tool 108 hanging below the casing 112 (FIG. 2B). Next, the casing 112 is run into the wellbore 104 with the logging tool 108 hanging below (FIG. 2C). The logging tool 108 starts logging when it reaches the open hole 102. The casing 112 is run until the logging tool 108 reaches the total depth, i.e., the bottom of the wellbore 104. At this point, the latching device 110 is released from the axial/torque lock 118, for example, using pressure pulses, and a retrieval tool 120 is run into the casing 112 to retrieve the latching device 110 and logging tool 108 through the casing 112 (FIG. 2D). Next, a cement float retainer (not shown) is pumped down the casing 112 until it engages the axial/torque lock 118. With the cement float retainer in place, the casing 112 is then cemented in place in a conventional manner.

In an alternative procedure, instead of coupling the logging tool 108 to the casing 112 at the surface, the casing 112, equipped with the axial/torque lock 118, is run into the wellbore 104 without the logging tool 108 hanging below. When the axial/torque lock 118 is about to emerge into the open hole 102, running of the casing 112 is stopped. Then, the latching device 110 and logging tool 108 are lowered into the casing 112 on the end of a wireline cable or slickline or coiled tubing. The latching device 110 is mated with the axial/torque lock 118 at the bottom end of the casing 112 so that the logging tool 108 then hangs below the casing 112. Then, running of the casing 112 and logging using the logging tool 108 continues as shown in FIG. 2C.

The logging speed is the same as the casing trip-in speed and may be adjusted based on the type of measurements to be made. For example, sonic and resistivity measurements can be made at high logging speeds. Therefore, the logging speed when making measurements using sonic and resistivity tools can be high. On the other hand, the optimal logging speed for density measurements using typical LWD density tool is about 200 ft/hr (1.69 cm/s) or less. In this case, the logging speed can be slowed down over interesting areas where density measurements would be taken. These interesting areas may have already been identified from MWD gamma-ray or mud logging taken when drilling the open hole 102.

The logging devices included in the logging tool 108 may be existing logging devices used in LWD tools or may be purposely built logging devices. For example, it is not necessary that the logging devices included in the logging tool 108 have mud flow passages. Further, the logging devices included in the logging tool 108 may be sized such that the logging tool 108 can fit through the smallest casing that would be run into the wellbore 104. A logging tool having an overall diameter of about 3 in. (7.62 cm) would be able to fit inside most casing strings. This way, the same logging tool 108 can be used for all logging services in the wellbore 104. The logging tool 108 preferably includes batteries and recording memory similar to LWD tools. The logging tool 108 could have a main power cartridge and recording memory or each logging device included in the logging tool could be equipped with power and recording memory. The logging tool 108 does not have to be as rugged as an LWD tool since it would not have to take weight-on-bit and torque-on-bit of drilling operations. The logging tool 108 could be made lightweight so that it can be retrieved using a standard wireline cable. The data stored in the logging tool 108 may be transmitted to the surface using the wireline cable before the logging tool is retrieved to the surface.

The invention typically provides the following advantages. The logging tool can be run below a casing to monitor an open hole section of a wellbore. Risk and cost of logging in an unstable downhole environment are reduced since the open hole is cased as it is logged. Also, the quality of data collected is high because the logging devices are not enclosed in the casing. The latching device can be made less rugged than, for example, the Tesco DLA since the logging system is not intended for drilling. The logging tool can be made lightweight so that it can be retrieved by standard wireline cable and sheave rather than a split crown on the rig as required for the Tesco DLA. This means that the logging system of the invention can be used on any rig. The logging speed can be very high and can also be slowed down as needed when making certain measurements, such as density measurements. The logging tool can include both conventional and specialized logging tools.

While the invention has been described with respect to a limited number of embodiments, those skilled in the art, having benefit of this disclosure, will appreciate that other embodiments can be devised which do not depart from the scope of the invention as disclosed herein. For example, while conventional casing/liners are formed of metal, embodiments of the invention can be implemented using non-metallic (e.g. composite) casings/liners.

What is claimed is:

1. A system for determining a subsurface parameter, comprising:

a casing adapted for disposal within a subsurface wellbore;

a logging tool comprising one or more formation evaluation logging devices; and a latching device coupling the logging tool to the casing such that the logging tool hangs below the casing when the casing is disposed in the wellbore.

2. The system of claim 1, wherein the latching device releasably couples the logging tool to the casing.

3. The system of claim 2, wherein the casing is equipped with a lock having a profile that engages a locking surface on the latching device.

4. The system of claim 2, wherein the latching device comprises a retrievable head which allows it to be retrieved through the casing.

5. The system of claim 1, wherein the logging tool is sized to pass through the casing.

6. The system of claim 1, wherein the logging devices are selected from the group consisting of acoustic tools, resistivity tools, neutron tools, density tools, gamma-ray tools, nuclear magnetic resonance tools, formation pressure tools, imaging tools, dipmeter, ultrasonic caliper, gravity sensors, seismic sources, seismic sensors, and combinations thereof.

7. The system of claim 1, wherein one of the logging devices comprises a pad through which it senses a formation surrounding the wellbore.

8. The system of claim 7, wherein the logging tool further comprises a mechanism for biasing the pad against a side of the wellbore.

9. The system of claim 1, wherein the logging tool further comprises a hinge joint which allows pivoting of a section of the logging tool as the logging tool traverses the wellbore.

10. The system of claim 1 wherein the logging tool is assembled in a device other than a drill collar.

11. The system of claim 1 wherein the logging tool comprises a recording device for storing measurements made by the logging tool.

12. The system of claim 1 wherein the logging tool comprises a measurement while drilling telemetry device for transmitting measurements made by the logging tool to the surface.

13. A method of determining a subsurface parameter, comprising:

disposing a casing in a subsurface wellbore;

coupling a logging tool comprising one or more logging devices to the casing such that the logging tool hangs below the casing; and running the casing along the wellbore, wherein the logging tool makes measurements as the casing is run along the wellbore.

14. The method of claim 13, wherein coupling the logging tool occurs before disposing the casing in the wellbore.

15. The method of claim 13, wherein coupling the logging tool occurs after disposing the casing in the wellbore by inserting the logging tool through the casing.

16. The method of claim 13, further comprising biasing a pad on the logging tool against a formation to be logged.

17. The method of claim 13, further comprising running the casing to the bottom of the wellbore.

18. The method of claim 17, further comprising releasing the logging tool from the casing and retrieving the logging tool through the casing.

* * * * *